US007500825B2

(12) United States Patent
Hanai

(10) Patent No.: US 7,500,825 B2
(45) Date of Patent: Mar. 10, 2009

(54) CENTRIFUGAL BLOWER

(75) Inventor: Tetsuya Hanai, Utsunomiya (JP)

(73) Assignee: Keihin Corporation, Tokyo (JP)

( * ) Notice: Subject to any disclaimer, the term of this patent is extended or adjusted under 35 U.S.C. 154(b) by 53 days.

(21) Appl. No.: 11/408,478

(22) Filed: Apr. 21, 2006

(65) Prior Publication Data

US 2006/0239815 A1 Oct. 26, 2006

(30) Foreign Application Priority Data

Apr. 21, 2005 (JP) ..... 2005-123692

(51) Int. Cl.
*F04D 29/44* (2006.01)

(52) U.S. Cl. ..... 415/204

(58) Field of Classification Search ..... 415/204, 415/206, 207

See application file for complete search history.

(56) References Cited

U.S. PATENT DOCUMENTS 5,839,879 A 11/1998 Kameoka et al.
6,881,031 B2 4/2005 Nomura

FOREIGN PATENT DOCUMENTS

| | | |
|---|---|---|
| JP | 05-195995 | 8/1993 |
| JP | 5-312194 | 11/1993 |
| JP | 9-158898 | 6/1997 |
| JP | 2004-27979 | 1/2004 |

OTHER PUBLICATIONS

Chinese Office Action for Application No. 200610076604.X, dated Feb. 29, 2008.

*Primary Examiner*—Edward Look
*Assistant Examiner*—Dwayne J White
(74) *Attorney, Agent, or Firm*—Lahive & Cockfield, LLP; Anthony A. Laurentano, Esq.

(57) ABSTRACT

A centrifugal blower has a fan rotatable by a rotational drive source and a scroll casing housing the fan and having first and second discharge passages. The first and second discharge passages have radial dimensions or widths and vertical dimensions which are progressively greater toward an opening. The first and second discharge passages are surrounded by a radially outer wall, a slanted strip joined to the outer wall, and a joint skirt interconnecting an annular step on which the fan is mounted and the slanted strip.

11 Claims, 10 Drawing Sheets

CENTRIFUGAL BLOWER

BACKGROUND OF THE INVENTION

1. Field of the Invention

The present invention relates to a centrifugal blower, and more particularly to a centrifugal blower for use in air conditioning units for motor vehicles.

2. Description of the Related Art

Heretofore, air conditioning units for motor vehicles have employed a centrifugal blower comprising a fan for introducing air from outside or inside of the motor vehicle, an electric motor for rotating the fan, and a casing housing the fan therein.

When the fan is rotated by the electric motor, air flows through a spiral air passage defined in the casing around the fan at a predetermined rate toward the passenger compartment of the motor vehicle. In order to increase the rate at which air flows toward the passenger compartment, the spiral air passage has its cross-sectional area progressively greater from an end thereof close to the electric motor where the spiral turn of the air passage begins toward another end thereof where the spiral turn of the air ends. Also, the casing has a slanted surface lying along an angle at which air is discharged from the centrifugal blower. The slanted surface includes a twisted surface whose angle with respect to a substantially horizontal plane is progressively greater from the electric motor toward the outlet of the centrifugal blower. For details, reference should be made to Japanese Laid-Open Patent Publication No. 9-158898, for example.

Recently, there has been a demand for a further increase in the rate of the air flow from the inlet toward outlet of the casing in the centrifugal blower. One solution is to increase the output power of the electric motor which rotates the fan to increase the rate of the air flow discharged by the fan out of the centrifugal blower. However, increasing the output power of the electric motor naturally tends to increase the size of the electric motor and hence the cost thereof, resulting in an increase in the overall size of the centrifugal blower.

SUMMARY OF THE INVENTION

It is a general object of the present invention to provide a centrifugal blower which is capable of reducing the generation of a swirling air flow in a casing when air flows through the casing, thereby to allow the air to flow smoothly through the casing for increasing the rate of air discharged from the outlet of the casing.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
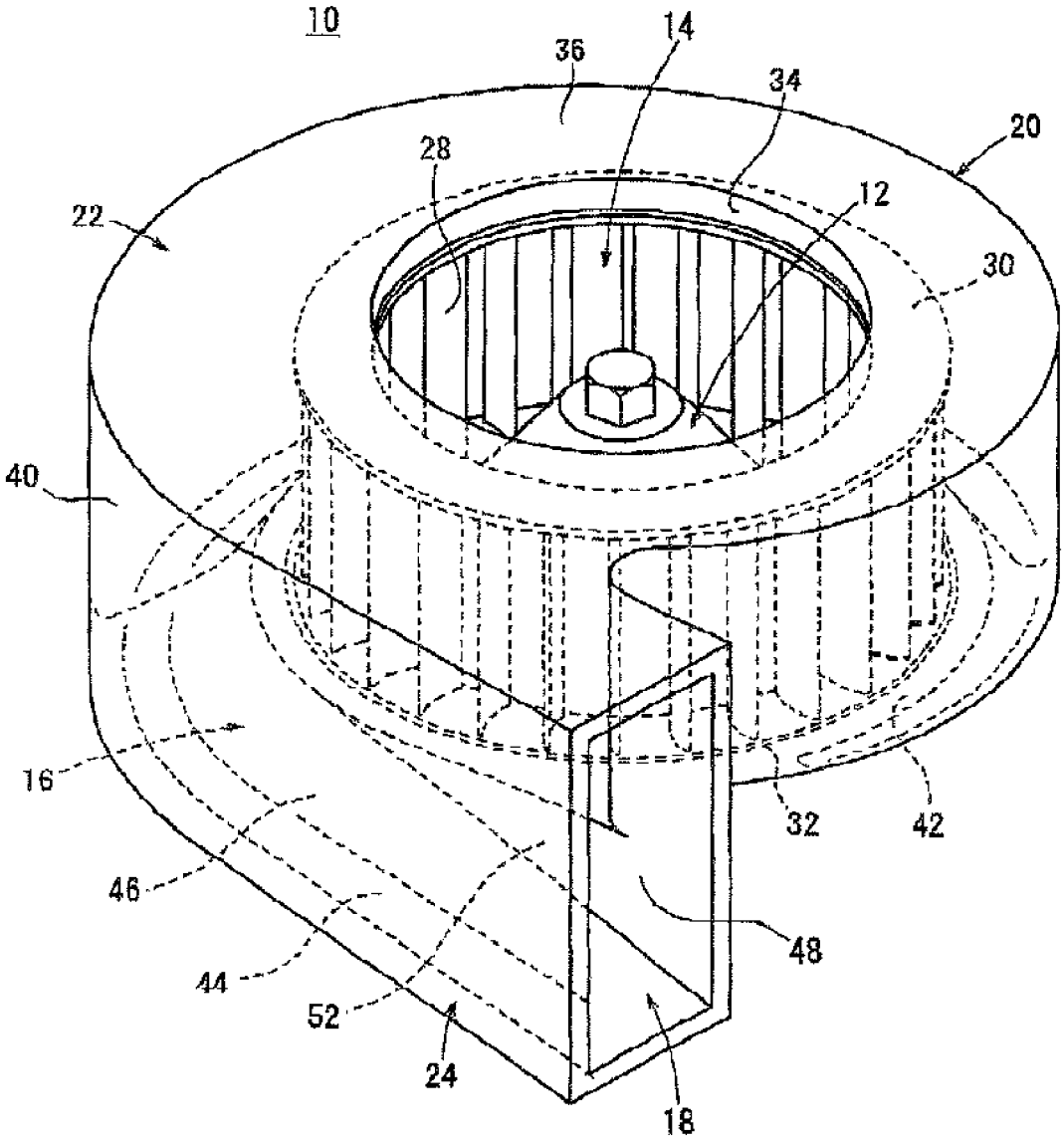
FIG. 1 is a perspective view of a centrifugal blower according to a first embodiment of the present invention.
Figure 2:
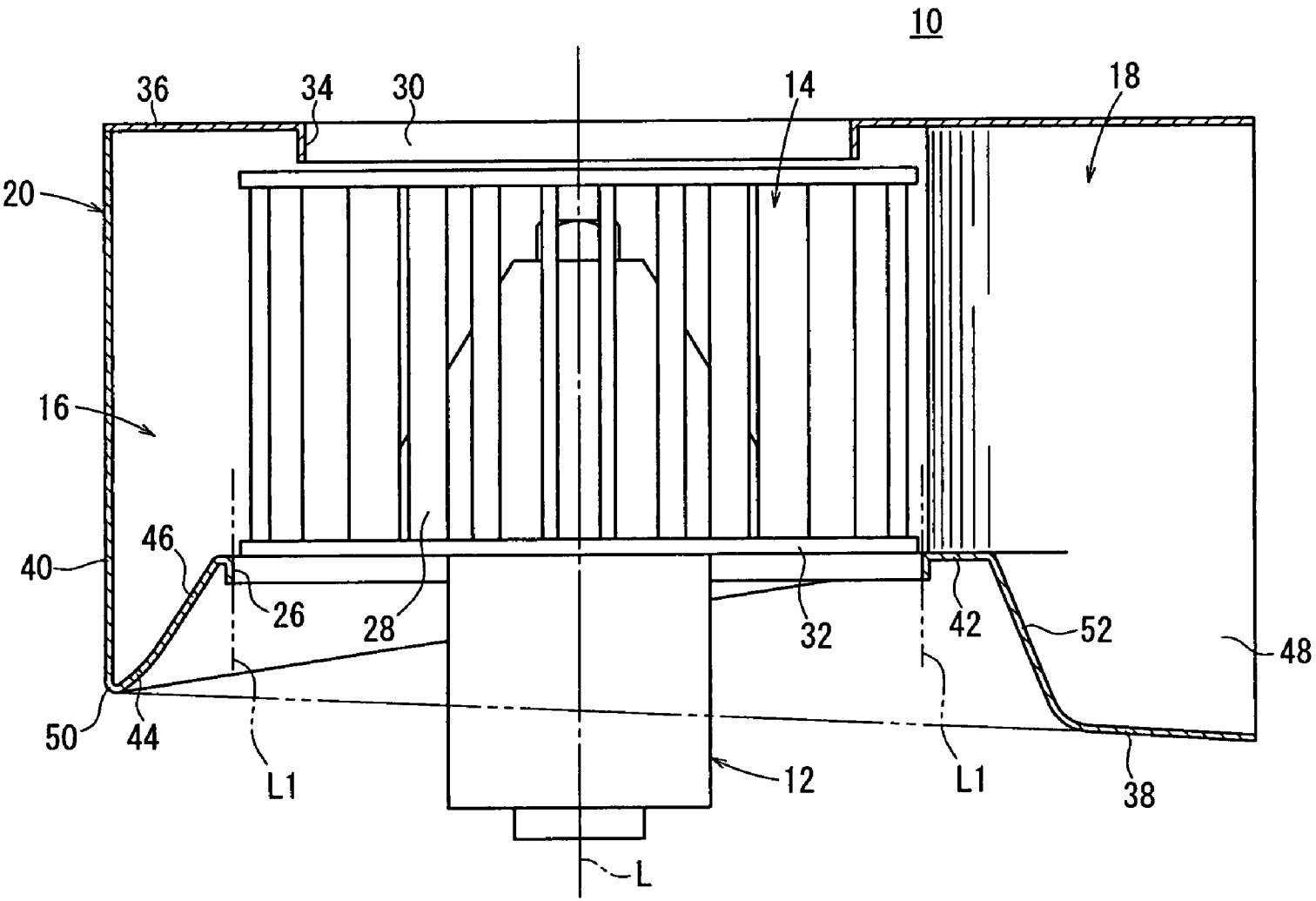
FIG. 2 is a vertical cross-sectional view of the centrifugal blower shown in FIG. 1.
Figure 3:
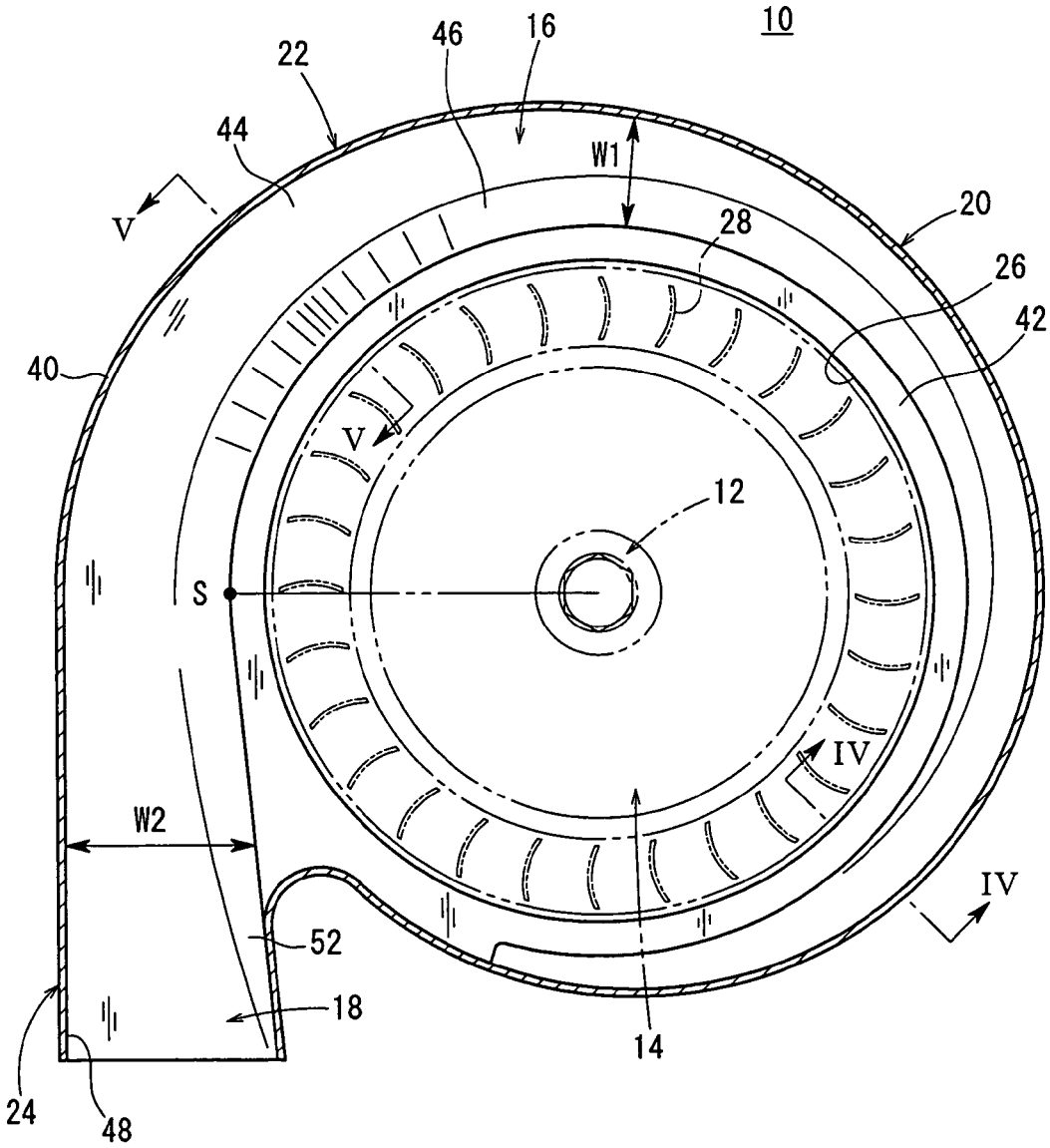
FIG. 3 is a horizontal cross-sectional view of the centrifugal blower shown in FIG. 1.

FIGS. 1 through 3 show a centrifugal blower 10 according to a first embodiment of the present invention.

As shown in FIGS. 1 and 2, the centrifugal blower 10 has a rotational drive source 12 such as an electric motor, a fan 14 rotatable by the rotational drive source 12, and a scroll casing 20 disposed in surrounding relation to an outer circumferential surface of the fan 14. The scroll casing 20 has, defined therein, a first spiral discharge passage 16 for air to pass therethrough and a second straight discharge passage 18 extending from the first discharge passage 16. The scroll casing 20 includes a main casing body 22 housing the rotational drive source 12 and the fan 14 and having the first discharge passage 16 defined therein, and an enlarged casing body 24 joined to the main casing body 22 and having the second discharge passage 18 defined therein.

The rotational drive source 12 is placed in a through hole 26 (see FIG. 2) defined in the main casing body 22 and fixed to the main casing body 22. The fan 14 is secured to the shaft (not shown) of the rotational drive source 12 and accommodated substantially centrally in the main casing body 22. The fan 14 comprises a circular array of blades 28 spaced at equal angular intervals in a circumferential direction, an annular holder ring 30 joined to the upper ends of the blades 28, and a bottom plate 32 joined to the lower ends of the blades 28. The fan 14 is rotatably supported by a support means (not shown) for rotation with respect to the scroll casing 20.

The main casing body 22 is in the form of a hollow cylinder surrounding the rotational drive source 12 and the fan 14. The main casing body 22 comprises an upper plate 36 disposed above the fan 14 and having an air inlet port (suction port) 34, a lower plate 38 disposed below the fan 14 in vertically confronting relation to the upper plate 36, and an outer wall 40 joining the outer circumferential edges of the upper and lower plates 36, 38. The first discharge passage 16 is surrounded by the upper plate 36, the lower plate 38, and the outer wall 40, and air discharged from the fan 14 passes through the first discharge passage 16. The first discharge passage 16 extends around an annular step 42 of the main casing body 22 (see FIG. 3). The outer wall 40 extends substantially parallel to the rotatable shaft (not shown) of the rotational drive source 12.

As shown in FIG. 3, the first discharge passage 16 has a cross-sectional area progressively greater from the fan 14 toward the enlarged casing body 24 at an outlet end. The distance from the center of the fan 14 to the outer circumferential edge of the first discharge passage 16 is progressively greater toward the enlarged casing body 24. Stated otherwise, the radial width W1 of the first discharge passage 16 is progressively greater toward the enlarged casing body 24.

As shown in FIG. 2, the lower plate 38 has the annular step 42 disposed closely around the bottom plate 32, a slanted strip 44 disposed adjacent to the outer wall 40, and a joint skirt (slanted strip) 46 disposed between the annular step 42 and the slanted strip 44 and inclined downwardly radially outwardly of the fan 14. Stated otherwise, the joint skirt 46 is obliquely joined to the annular step 42, the slanted strip 44 is obliquely joined to the outer wall 40, and the joint skirt 46 and the slanted strip 44 are joined to each other. The slanted strip 44 is curved so as to be slightly convex downwardly.

As shown in FIGS. 1 and 2, the enlarged casing body 24 is of a substantially elongated rectangular cross-sectional shape for being joined to the main casing body 22. The enlarged casing body 24 has the second discharge passage 18 communicating with the first discharge passage 16 of the main casing body 22 and an opening (outlet port) 48 for discharging out air that has flowed through the second discharge passage 18.

The second discharge passage 18 has its cross-sectional area progressively greater from the main casing body 22 toward the opening 48. Stated otherwise, the radial width W2 of the second discharge passage 18 is progressively greater toward the opening 48 (see FIG. 3). The width W1 of the first discharge passage 16 is smaller than the width W2 of the second discharge passage 18 (W1<S2).

The second discharge passage 18 is connected to the end of first discharge passage 16, and extends tangentially straight from a point S (FIG. 3) of contact between the outer circumferential edge of the annular step 42 and the first discharge passage 16, in a direction away from the first discharge passage 16.

The slanted strip 44 extends from the first discharge passage 16 of the main casing body 22 into the second discharge passage 18 of the enlarged casing body 24, i.e., the slanted strip 44 extends along the first discharge passage 16 and the second discharge passage 18. The slanted strip 44 is progressively inclined downwardly away from the upper plate 36 in a direction from an end portion of the first discharge passage 16 where the slanted strip 44 is narrower toward the opening 48 in the enlarged casing body 24 where the slanted strip 44 is wider (see FIG. 2). The first and second discharge passages 16, 18 have their cross-sectional area progressively greater vertically and horizontally in a direction from the main casing body 22 to the enlarged casing body 24.

Figure 4:
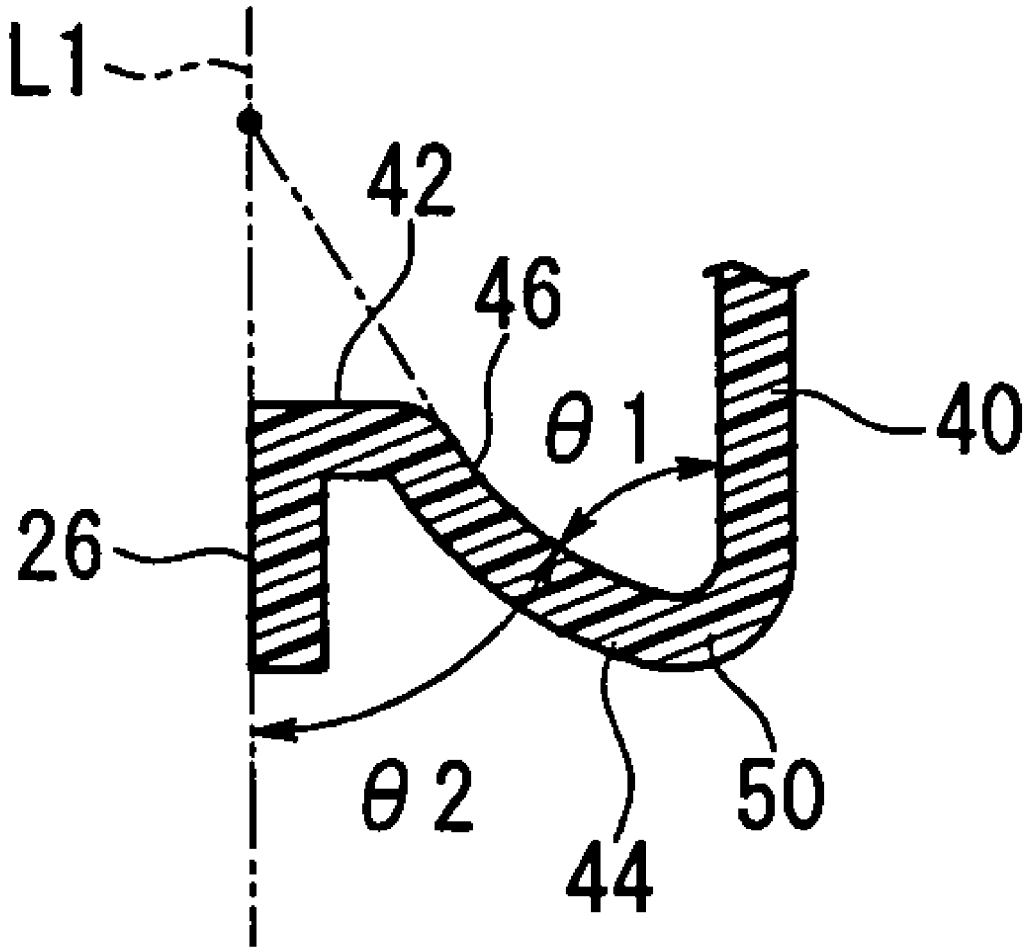
FIG. 4 is an enlarged fragmentary cross-sectional view taken along line IV-IV of FIG. 3.
Figure 5:
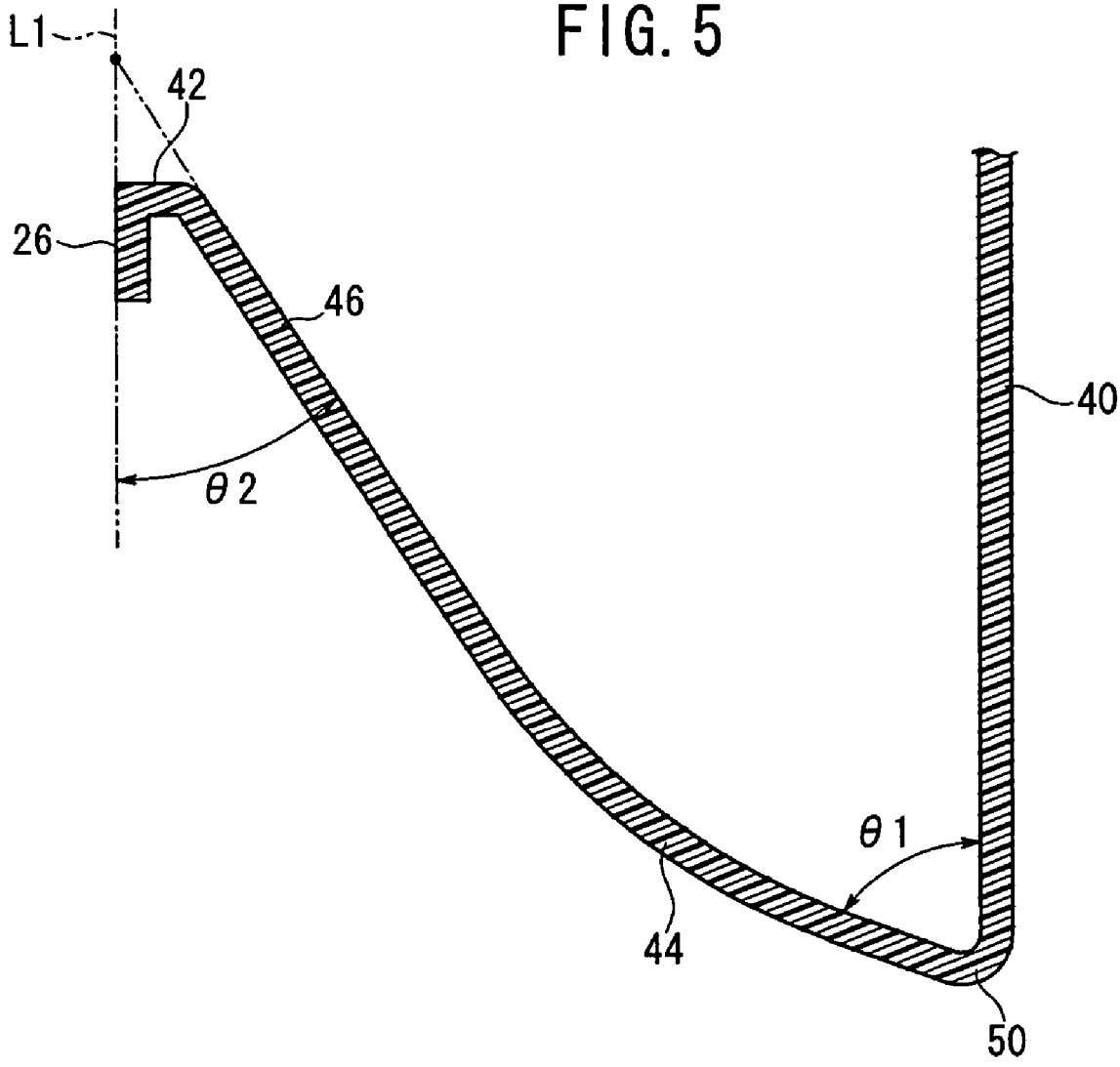
FIG. 5 is an enlarged fragmentary cross-sectional view taken along line V-V of FIG. 3.
Figure 6:
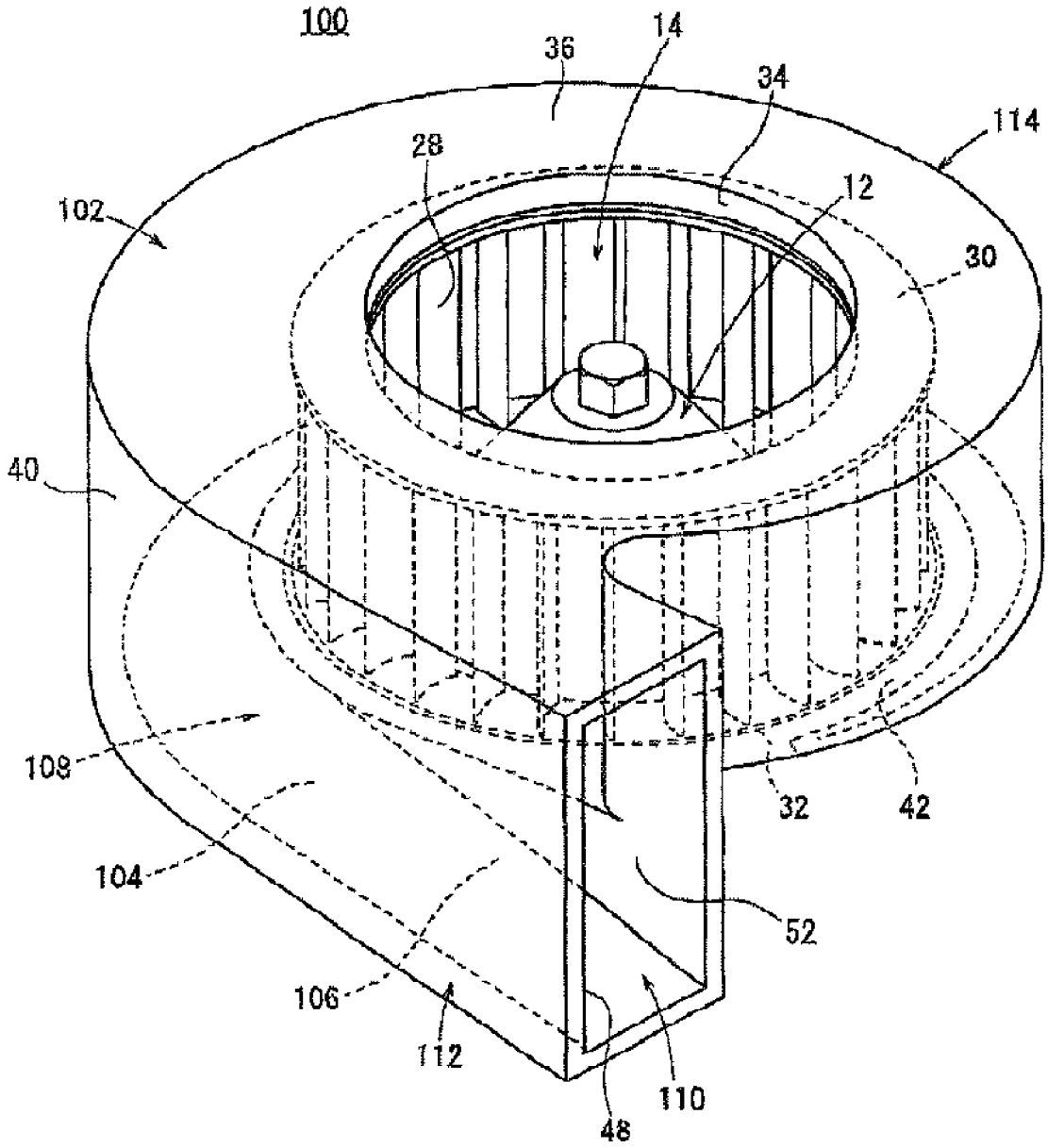
FIG. 6 is a perspective view of a centrifugal blower according to a second embodiment of the present invention.

As shown in FIGS. 4 and 5, the slanted strip 44 is connected at a predetermined acute angle θ1 to the outer wall 40 by a junction 50 having a substantially arcuate cross-sectional shape. If the acute angle θ1 is unnecessarily small, the cross-sectional areas of the first and second discharge passages 16, 18 are unduly reduced. The acute angle θ1 should preferably be 45° or greater.

As shown FIG. 2, the joint skirt 46 is inclined a predetermined angle θ2 (FIGS. 4 and 5) radially outwardly and downwardly with respect to a hypothetical line L1 that is substantially parallel to the axis L of the fan 14. The angle θ2 is the smallest in a joint region where the first discharge passage 16 and the second discharge passage 18 are joined to each other, and is progressively greater from the joint region toward the opening 48.

Therefore, the scroll casing 20 has the slanted strip 44 and the joint skirt 46 between the outer wall 40 extending substantially parallel to the axis L of the fan 14 and the annular step 42, the slanted strip 44 and the joint skirt 46 being spirally turned while being inclined radially outwardly and downwardly from the annular step 42.

Figure 10:
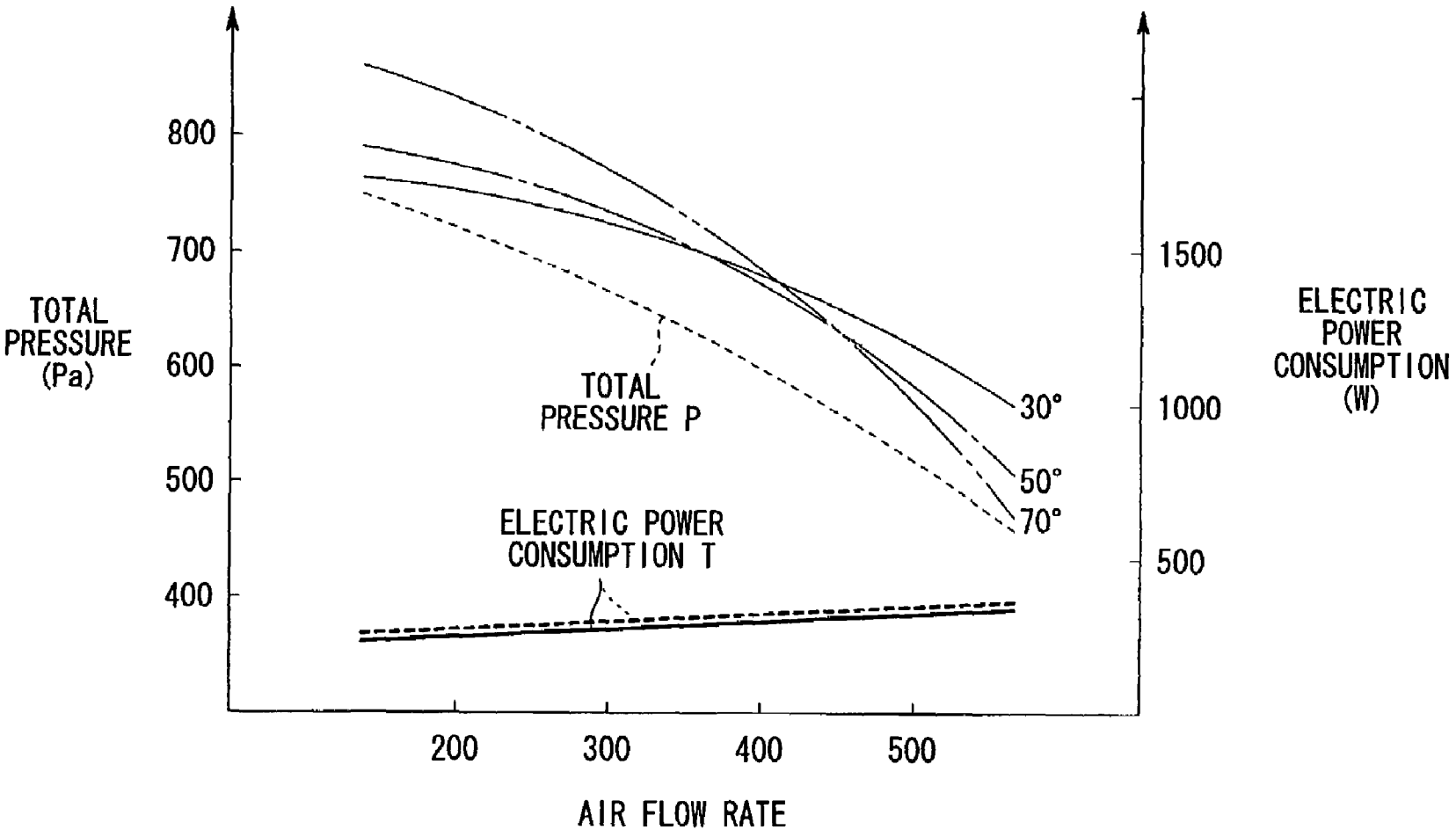
FIG. 10 is a diagram showing characteristic curves representative of the relationship between the air flow rate, the total pressure P, and the electric power consumption T of the centrifugal blowers shown in FIGS. 1 and 6.

As shown in FIG. 10, if the pressure (total pressure P) in the scroll casing 20 is to be increased at a low air flow rate, i.e., when air flows at a low rate through the scroll casing 20, then the angle θ2 should preferably be in a range from 60° to 85° (60°≦θ2≦85°). If the pressure (total pressure P) in the scroll casing 20 is to be increased at a high air flow rate, i.e., when air flows at a high rate through the scroll casing 20, then the angle θ2 should preferably be in a range from 30° to 60° (30°≦θ2≦60°). FIG. 10 shows characteristic curves representative of the relationship between the air flow rate and the total pressure P when the angle θ2 in the centrifugal blower 10 is 30°, 50°, and 70°, and the relationship between the air flow rate and the electric power consumption T of the centrifugal blower 10. The air flow rate is represented by a solid-line curve when the angle θ2 is 30°, a dot-and-dash-line curve when the angle θ2 is 50°, and a two-dot-and-dash line curve when the angle θ2 is 70°.

Since the first and second discharge passages 16, 18 are progressively enlarged downwardly toward the opening 48 of the enlarged casing body 24, an inner wall 52 is provided radially inwardly in the first and second discharge passages 16, 18 between the first and second discharge passages 16, 18 and the annular step 42. The inner wall 52 has a height that is progressively greater toward the opening 48. Stated otherwise, the inner wall 52 is provided as a portion of the joint skirt 46 interconnecting the annular step 42 and the slanted strip 44.

Generally in centrifugal blowers having a spiral discharge passage extending around a fan, when air expelled by the fan flows through the spiral discharge passage, swirling air flows are developed in respective upper and lower portions of the spiral discharge passage along the axis of the fan. When the air flows while rotating along the outer wall of the spiral discharge passage and flows from the terminal end of the spiral discharge passage into a straight outlet passage, the swirling air flows are produced because part of the air does not flow straight toward the outlet passage, but flows swirlingly due to inertia along the outer wall.

At this time, part of the air is entrapped swirlingly back into the fan in the vicinity of the outlet passage. Therefore, part of the air which should be discharged from the fan into the outlet passage is not discharged from the outlet passage. The swirling air flow is considered to cause the centrifugal blower to discharge air at a slightly reduced rate.

According to the present invention, the slanted strip 44 and the joint skirt 46 in the first and second discharge passages 16, 18 are inclined downwardly such that the angle θ2 formed between the joint skirt 46 and the annular step 42 is progressively greater, and are inclined progressively downwardly toward the opening 48. Therefore, the first and second discharge passages 16, 18 have their radial widths W1, W2 and vertical dimensions progressively increased toward the opening 48. Stated otherwise, the first and second discharge passages 16, 18 have their cross-sectional areas progressively greater toward the opening 48.

When air flows from the fan 14 along the outer wall 40 of the first discharge passage 16 closely to the boundary region between the first discharge passage 16 and the second discharge passage 18, part of the air is prevented from flowing swirlingly to the fan 14 by the inner wall 52 of the first and second discharge passages 16, 18. Consequently, part of the air is essentially forcibly caused by the inner wall 52 to flow toward the opening 48. The slanted strip 44 and the joint skirt 46 that are provided in the scroll casing 20 to form the inner wall 52 are, therefore, effective to reduce a swirling air flow that is produced when air flows from the first discharge passage 16 through the second discharge passage 18 to the opening 48.

Furthermore, since the slanted strip 44 is joined at an acute angle to the outer wall 40, air is allowed to flow smoothly between the slanted strip 44 and the outer wall 40, and is limited against flowing radially inwardly between the slanted strip 44 and the outer wall 40. Stated otherwise, air is reliably guided to flow toward the opening 48.

As a result, air expelled from the fan 14 is guided to flow smoothly in the scroll casing 20 between the inner wall 52 provided radially inwardly in the first and second discharge passages 16, 18, and the slanted strip 44 and the outer wall 40 which are joined at an acute angle to each other, and discharged out of the opening 48. Consequently, the rate of air discharged from the centrifugal blower 10 is increased.

In addition, because the efficiency with which air flows through the scroll casing 20 is increased, the electric power consumption T (see the solid-line curve in FIG. 10) of the rotational drive source 12 of the centrifugal blower 10 is made lower than the electric power consumption (see the broken-line curve in FIG. 10) of the rotational drive source of the conventional centrifugal blower. As air is prevented from being entrapped into the fan 14 by the inner wall 52 of the first and second discharge passages 16, 18, noise generated when the air is disturbed is reduced.

FIGS. 6 through 9 show a centrifugal blower 100 according to a second embodiment of the present invention. Those parts of the centrifugal blower 100 which are identical to those of the centrifugal blower 10 according to the first embodiment are denoted by identical reference characters, and will not be described in detail below.

The centrifugal blower 100 according to the second embodiment differs from the centrifugal blower 10 according to the first embodiment in that it has a main casing body 102 including a slanted strip 104 and a joint skirt 106 which substantially horizontally lie at a substantially constant height along the axis of the fan 14, and the slanted strip 104 and the joint skirt 106 has portions inclined downwardly from a point in a first discharge passage 108 toward the opening 48.

Figure 8:
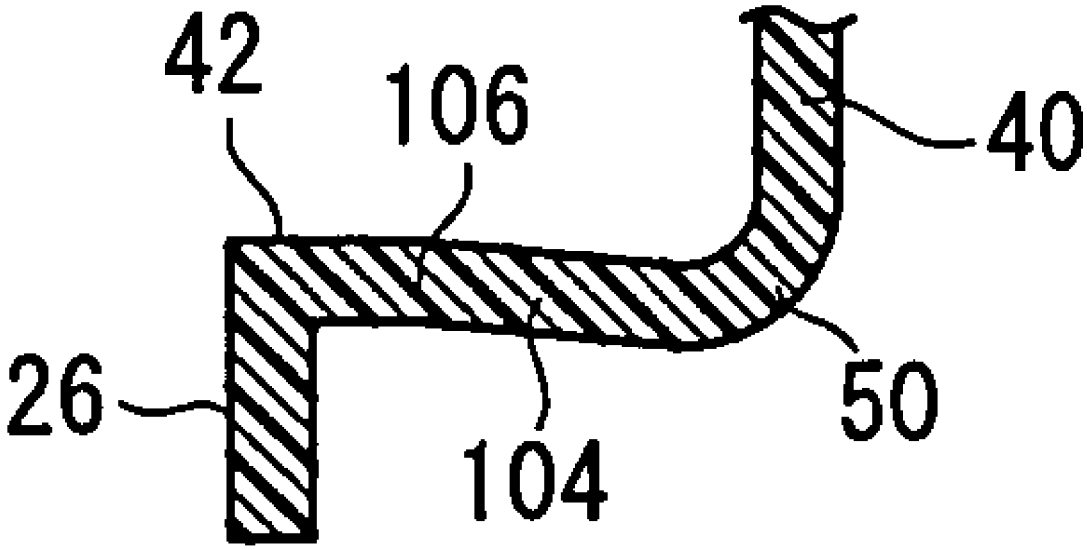
FIG. 8 is an enlarged fragmentary cross-sectional view taken along line VIII-VIII of FIG. 7.
Figure 9:
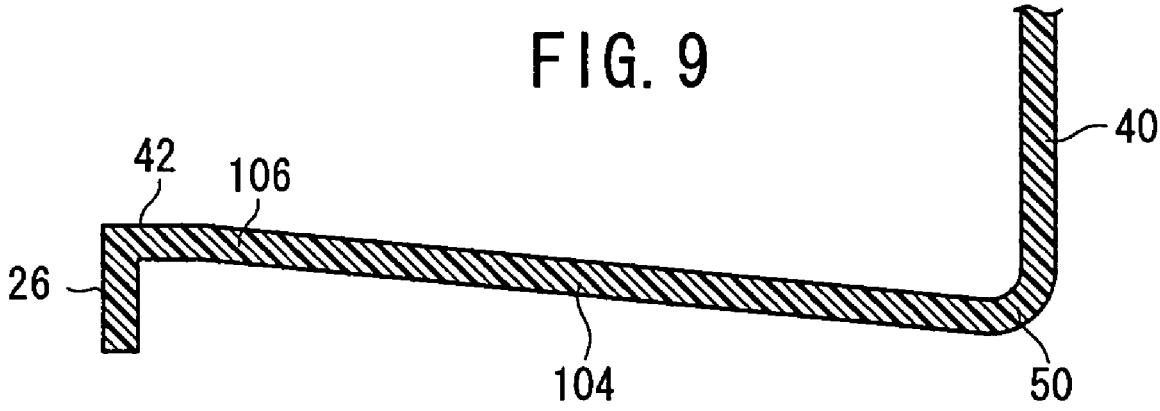
FIG. 9 is an enlarged fragmentary cross-sectional view taken along line IX-IX of FIG. 7.

As shown in FIGS. 8 and 9, the slanted strip 104 and the joint skirt 106 are on the substantially same plane with the upper surface of the annular step 42, or slightly inclined downwardly, and are inclined progressively downwardly toward the opening 48 from a position that is spaced into the first discharge passage 108 from a joint region where the first discharge passage 108 and a second discharge passage 110 are joined to each other.

Figure 7:
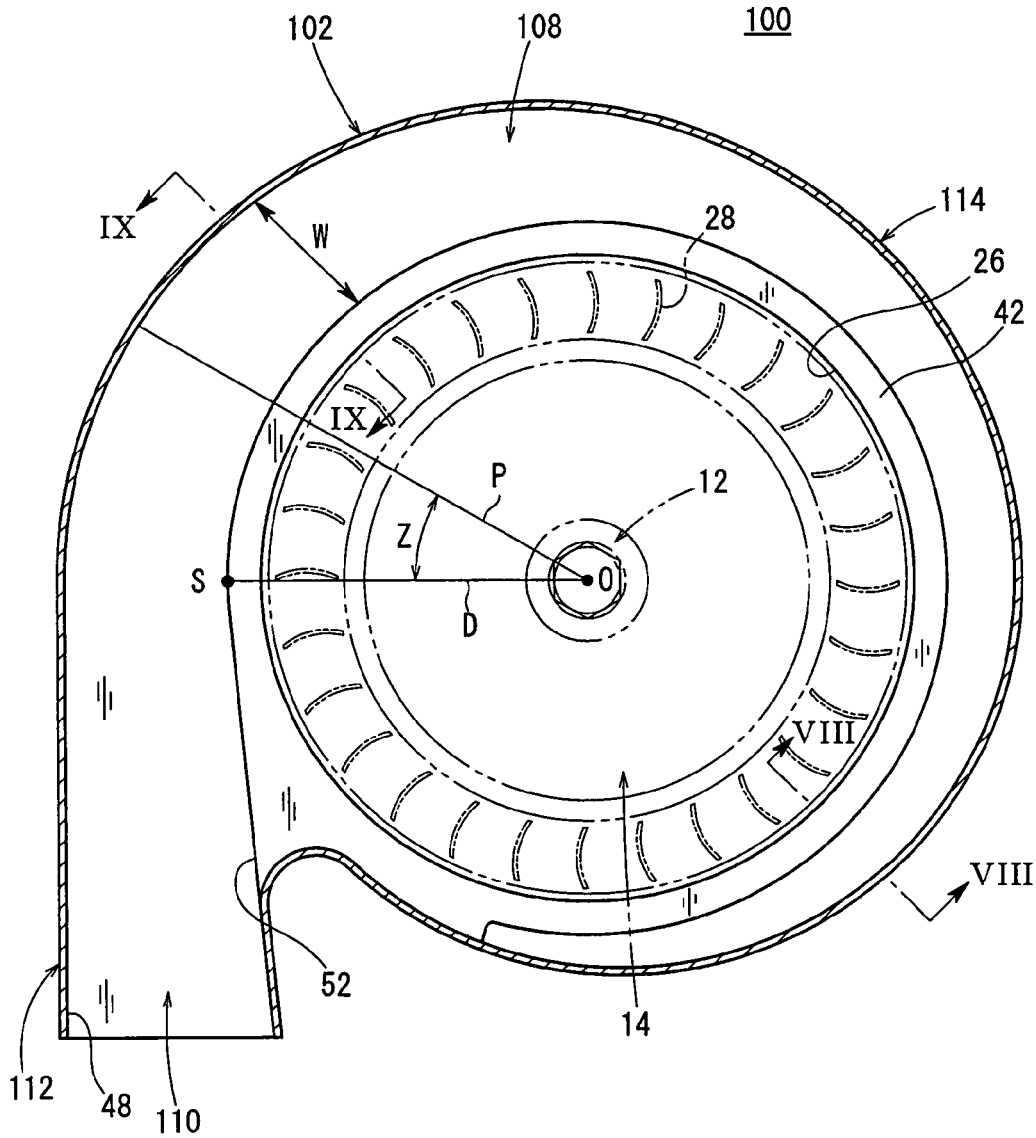
FIG. 7 is a horizontal cross-sectional view of the centrifugal blower shown in FIG. 6.

In greater detail, as shown in FIG. 7, a base line D is drawn as a line segment interconnecting a point S of contact between the outer circumferential edge of the annular step 42 and an inner wall of a straight enlarged casing body 112, and the center O of the annular step 42. The slanted strip 104 and the joint skirt 106 start being inclined downwardly from a position P that is angularly spaced from the base line D into the main casing body 102 by a predetermined angle Z (e.g., 30°).

The angle Z by which the position P is angularly spaced from the base line D should preferably be in the range from 20° to 45° ($20° \leqq Z \leqq 45°$) from the base line D toward the main casing body 102 or the opening 48.

The slanted strip 104 and the joint skirt 106 are inclined progressively downwardly toward the opening 48 of the enlarged casing body 112. The cross-sectional area of the opening 48 of the enlarged casing body 112 is substantially the same as the cross-sectional area of the opening of enlarged casing body 24 of the centrifugal blower 10 according to the first embodiment.

Specifically, in a scroll casing 114, the first discharge passage 108 in the main casing body 102 has a substantially constant vertical dimension or height. Therefore, the first discharge passage 108 is progressively enlarged only in the radial outward direction (transverse direction). Also, a portion of the first discharge passage 108 and the second discharge passage 110 are progressively enlarged toward the opening 48 in the vertical direction (height) as well as in the radial outward direction.

With the centrifugal blower 100 according to the second embodiment, as described above, the first discharge passage 108 has a substantially constant vertical dimension or height and only the radial dimension or width W thereof is progressively increased toward the opening 48. The slanted strip 104 and the joint skirt 106 start being inclined downwardly from the position P that is angularly spaced from the point S of contact between the annular step 42 and the enlarged casing body 112 into the main casing body 102 by the predetermined angle Z. Therefore, the cross-sectional area is prevented from increasing sharply from the first discharge passage 108 toward the second discharge passage 110 and the opening 48, and hence the rate at which air flows through the first and second discharge passages 108, 110 is prevented from being unduly lowered. As a result, by adjusting the position where the slanted strip 104 and the joint skirt 106 in the first and second discharge passages 108, 110 start being inclined downwardly, air is allowed to flow smoothly through the scroll casing 114, and the rate of air discharged by the centrifugal blower 100 is increased.

Furthermore, the pressure (total pressure P) in the centrifugal blower 100 is maintained at a suitable level by reducing a pressure loss in the centrifugal blower 100, and the electric power consumption T of the rotational drive source 12 thereof is reduced, as compared with the conventional centrifugal blower as indicated by the broken-line curves in FIG. 10.

Although certain preferred embodiments of the present invention have been shown and described in detail, it should be understood that various changes and modifications may be made therein without departing from the scope of the appended claims.

What is claimed is:

1. A centrifugal blower comprising:

a fan having a plurality of blades;

a casing housing said fan therein and having a discharge passage surrounding said fan, a suction port for drawing air therethrough into said discharge passage when said fan operates, and an outlet port for discharging air from said discharge passage therethrough out of said casing;

an annular step disposed in said discharge passage in confronting relation to said suction port with said fan interposed therebetween; and a joint portion disposed in said discharge passage and inclined from said annular step radially outwardly and in a direction away from said suction port, said joint portion being joined at an acute angle to an outer wall of said discharge passage and becoming gradually horizontal toward said outlet port so as to be continuous to a bottom surface of said outlet port;

said discharge passage having a cross-sectional area which is progressively greater radially outwardly toward said outlet port in the direction away from said suction port.

2. A centrifugal blower according to claim 1, wherein said discharge passage has a vertical dimension along an axis of said fan, said vertical dimension being progressively greater from an end of said discharge passage adjacent to said fan toward said outlet port.

3. A centrifugal blower according to claim 2, wherein said joint portion is inclined to an axis of said fan by an angle in the range from 30° to 60°.

4. A centrifugal blower according to claim 3, wherein said discharge passage comprises a first discharge passage surrounding said fan and a second discharge passage extending from said first discharge passage to said outlet port, said angle being the smallest in a joint region where said first discharge passage and said second discharge passage are joined to each other and the greatest in a region where said second discharge passage faces said outlet poll.

5. A centrifugal blower according to claim 2, wherein said joint portion is inclined to an axis of said fan by an angle in the range from 60° to 85°.

6. A centrifugal blower according to claim 5, wherein said discharge passage comprises a first discharge passage surrounding said fan and a second discharge passage extending from said first discharge passage to said outlet port, said angle being the smallest in a joint region where said first discharge passage and said second discharge passage are joined to each other and the greatest in a region where said second discharge passage faces said outlet poll.

7. A centrifugal blower according to claim 1, wherein said joint portion is joined to said outer wall and inclined to said outer wall at an acute angle of at least 45°.

8. A centrifugal blower comprising:

a fan having a plurality of blades;

a casing housing said fan therein and having a discharge passage surrounding said fan, a suction port for drawing air therethrough into said discharge passage when said fan operates, and an outlet port for discharging air from said discharge passage therethrough out of said casing;

an annular step disposed in said discharge passage in confronting relation to said suction port with said fan interposed therebetween; and a joint portion disposed in said discharge passage and inclined from said annular step radially outwardly and in a direction away from said suction port, said joint portion being joined to an outer wall of said discharge passage and becoming gradually horizontal toward said outlet port so as to be continuous to a bottom surface of said outlet port;

said discharge passage comprising an upstream first discharge passage surrounding said fan and a downstream second discharge passage extending from said first discharge passage, said first discharge passage having a cross-sectional area which is progressively greater radially outwardly toward said outlet port in said casing and said second discharge passage having a cross-sectional area which is progressively greater radially outwardly toward said outlet port in the direction away from said suction port.

9. A centrifugal blower according to claim 8, wherein said joint portion extends toward said outlet port from a position which is angularly spaced a predetermined angle about an axis of said fan into said first discharge passage from a joint region where said first discharge passage and said second discharge passage are joined to each other.

10. A centrifugal blower according to claim 9, wherein said angle is in the range from 20° to 45°.

11. A centrifugal blower according to claim 9, wherein said first discharge passage has a substantially constant vertical dimension along the axis of said fan.

* * * * *